US006648038B2

(12) United States Patent
Vetter

(10) Patent No.: US 6,648,038 B2
(45) Date of Patent: Nov. 18, 2003

(54) WALLET CARD REMINDER

(76) Inventor: Richard Vetter, 1320 Cassins St., Carlsbad, CA (US) 92009

( * ) Notice: Subject to any disclaimer, the term of this patent is extended or adjusted under 35 U.S.C. 154(b) by 0 days.

(21) Appl. No.: 10/194,086

(22) Filed: Jul. 11, 2002

(65) Prior Publication Data

US 2003/0015269 A1 Jan. 23, 2003

Related U.S. Application Data

(60) Provisional application No. 60/306,881, filed on Jul. 19, 2001.

(51) Int. Cl.[7] ..... A45C 1/06; A45C 11/18

(52) U.S. Cl. ..... 150/147; 150/134; 206/39; 116/200

(58) Field of Search ..... 150/134, 147, 150/132, 148, 149; 206/37, 39; 116/200

(56) References Cited

U.S. PATENT DOCUMENTS

| | | | | | |
|---|---|---|---|---|---|
| 1,582,492 | A | * | 4/1926 | Tantlinger | 150/147 |
| 1,791,703 | A | * | 2/1931 | Benedict et al. | 150/147 |
| 3,994,328 | A | * | 11/1976 | Reis | 150/147 |
| D310,138 | S | * | 8/1990 | Peters et al. | D3/56 |
| 5,052,328 | A | * | 10/1991 | Eppenbach | 150/134 X |
| 5,125,356 | A | * | 6/1992 | Galante | 116/200 |
| 5,370,419 | A | * | 12/1994 | Takayama | 150/147 X |
| 5,775,398 | A | * | 7/1998 | Siegel | 50/147 X |
| 5,881,788 | A | * | 3/1999 | Hersh et al. | 150/148 X |

FOREIGN PATENT DOCUMENTS

| | | | | |
|---|---|---|---|---|
| FR | 2551330 | * | 3/1985 | 150/147 |
| FR | 2635211 | * | 2/1990 | 150/147 |
| WO | 9104689 | * | 4/1991 | 150/147 |

* cited by examiner

*Primary Examiner*—Sue A. Weaver
(74) *Attorney, Agent, or Firm*—Leon D. Rosen

(57) ABSTRACT

A wallet is constructed so when a credit or identification card is withdrawn from a card pocket and is not replaced, the owner viewing the card pocket is reminded of the fact that the card has not been replaced. The pocket has a front wall with a top edge and a rear wall that extends higher than the front wall top edge. A prompt of highly attention-getting material such as a holographic type light-reflecting strip, is attached to the rear wall to lie above the top edge of the front wall. When a card lies in the pocket, the top portion of the card covers the attention-getting prompt, but when a card is not present the attention-getting prompt attracts the owner's attention to remind him that the card has not been replaced.

2 Claims, 3 Drawing Sheets

FIG. 3
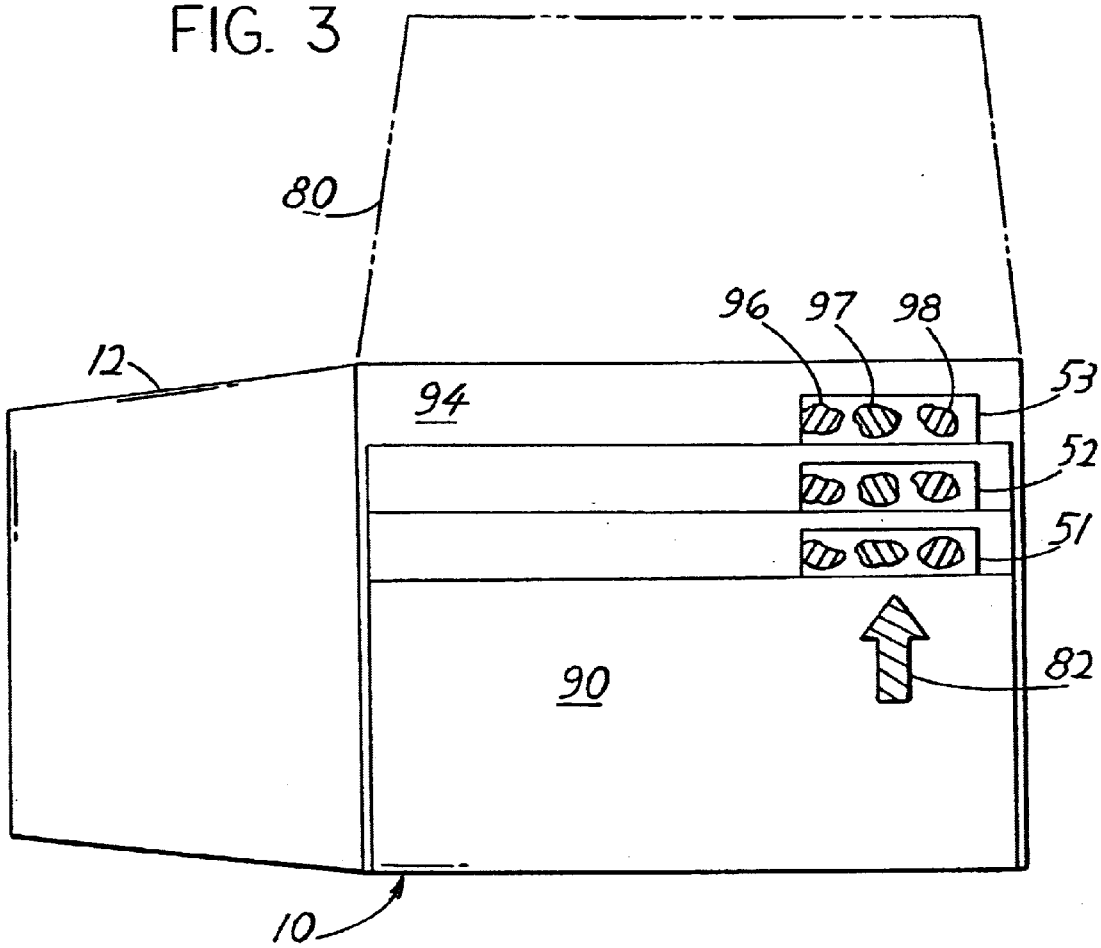
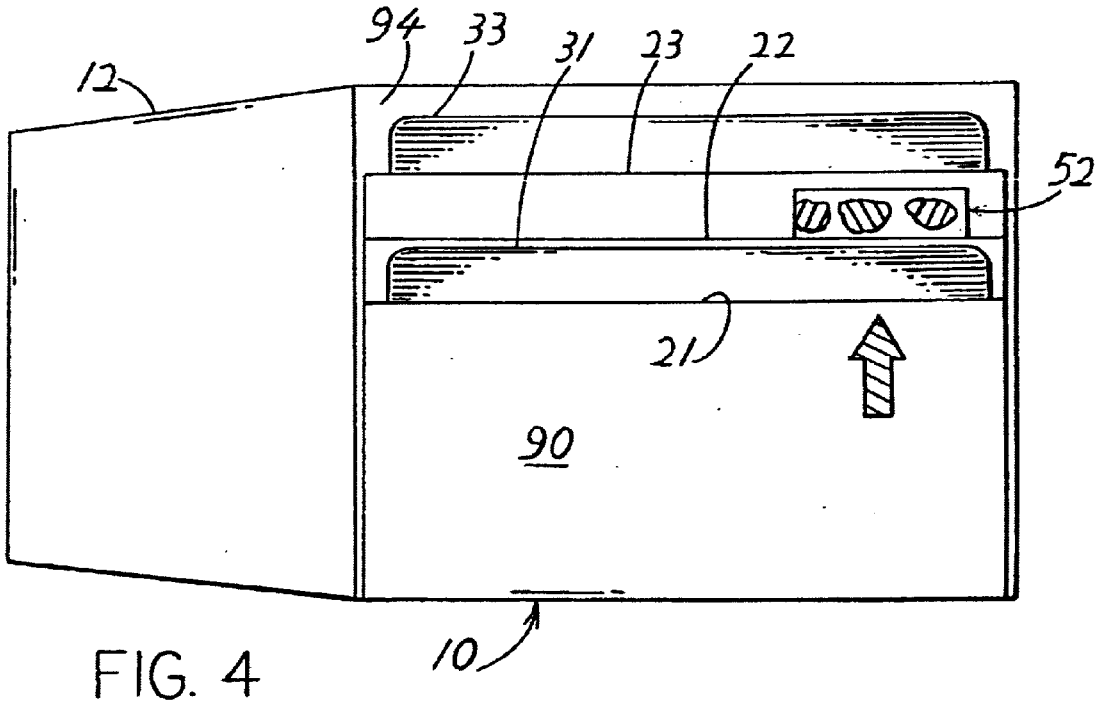
FIG. 4

WALLET CARD REMINDER

CROSS-REFERENCE TO RELATED APPLICATION

Applicant claims priority from U.S. Provisional application Ser. No. 60/306,881 filed Jul. 19, 2001.

BACKGROUND OF THE INVENTION

A person who withdraws a credit card, driver's license or like card from a card pocket in a wallet, sometimes forgets to replace the card in the card pocket. Systems have been developed that detect a missing card and sound a beep if the card has not been replaced when the wallet is closed. Such devices are commonly costly and add to the bulk of the wallet. Apparatus that reminded the person that the card was missing from its card pocket in the wallet, but which was very compact and of very low cost would be of value.

SUMMARY OF THE INVENTION

In accordance with one embodiment of the present invention, an apparatus is provided for use in a wallet or the like to indicate that a credit-card with a height of about 2.1 inches and length of about 3.3 inches, that has been removed from a pocket, has not been replaced. The apparatus includes walls forming pockets that lie one behind the other and that hold cards at progressively greater heights. A frontmost pocket has a bottom wall that is engaged by a fully inserted card. The pocket front wall has a top edge, and the card projects above the top edge. The rear wall of the pocket has an attention-getting display, or prompt, extending a plurality of millimeters above the top edge of the front wall. When a card lies in the frontmost pocket, the card covers the prompt. However, when the card does not lie in the wallet, the prompt is displayed to remind the person to return the card to the pocket.

The novel features of the invention are set forth with particularity in the appended claims. The invention will be best understood from the following description when read in conjunction with the accompanying drawings.

BRIEF DESCRIPTION OF THE DRAWINGS

FIG. 3 is a front elevation view of only the holder of FIG. 1, with no card lying in any of the three pockets.

FIG. 4 is view similar to FIG. 3, but with two of the three cards lying in their corresponding pockets.

DESCRIPTION OF THE PREFERRED EMBODIMENTS

Figure 1:
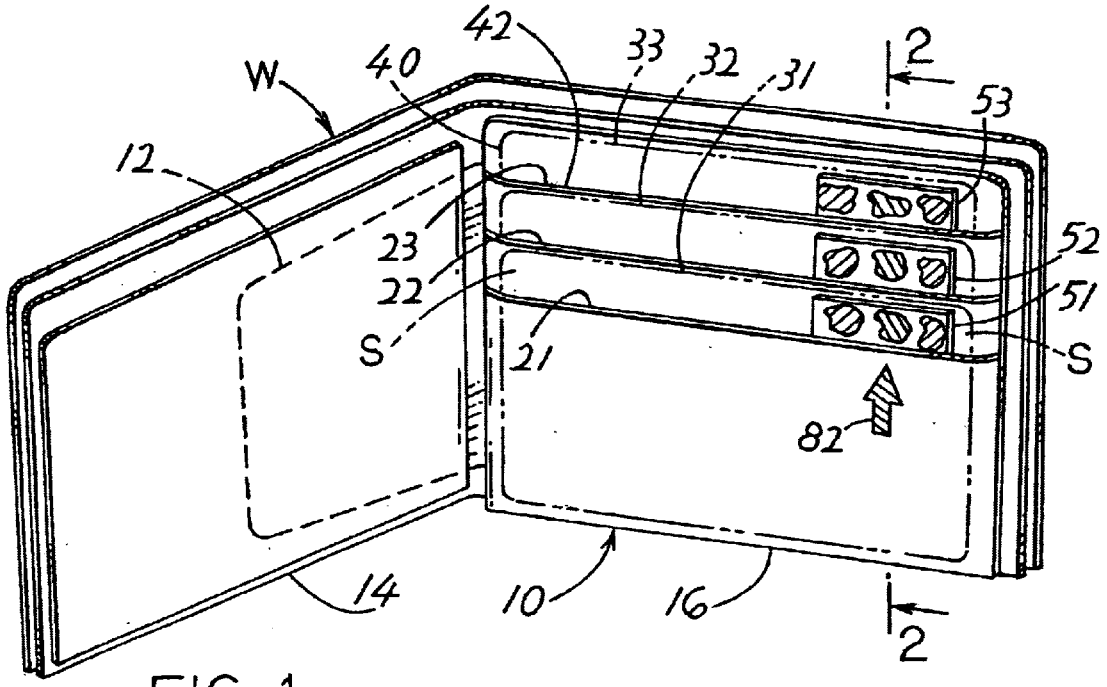
FIG. 1 is a front isometric view of a holder of the present invention, which lies in a wallet shown in its open wallet position, and showing cards that normally lie in three pockets of the holder only in phantom lines.

FIG. 1 illustrates a holder 10 that lies in a wallet W and that is held therein by an insert tab 12. The holder includes pockets 21–23 that are each constructed to hold a card indicated at 31–33. Each pocket is constructed so the card outer, or upper end or upper portion such as 40 projects a limited distance outward, or above the top edge 42 of the front wall of the pocket. When front and rear wallet walls 14, 16 are pivoted to the open position of FIG. 1, the upper ends of the cards 31–33 can be seen.

In accordance with the present invention, applicant provides an attention-getting marking or display, which can be referred to as a prompt 51, 52, 53 on the rear wall of each pocket, at a location outward, or above the top edge 42 of the front wall of the pocket. A view of the prompt from in front of the holder, is normally blocked by the upper end 40 of a card. However, the marking is readily seen when the card is missing.

A person will withdraw an identification card in a transaction, such as to give a credit card or driver's license to a clerk at a store, or to swipe a card through a machine. It sometimes occurs that the owner of the card does not take the card back from the clerk or places the card on a counter or elsewhere, and forgets to place the card back in a designated pocket in his wallet or other holder. When that person casually views the holder 10 of FIG. 1, the person's attention will be drawn to one of the prompts 51–53 that is exposed. This reminds the person that one of the cards that should lie in one of the pockets, is missing, and the person will look for the card to replace it in its pocket.

Figure 2:
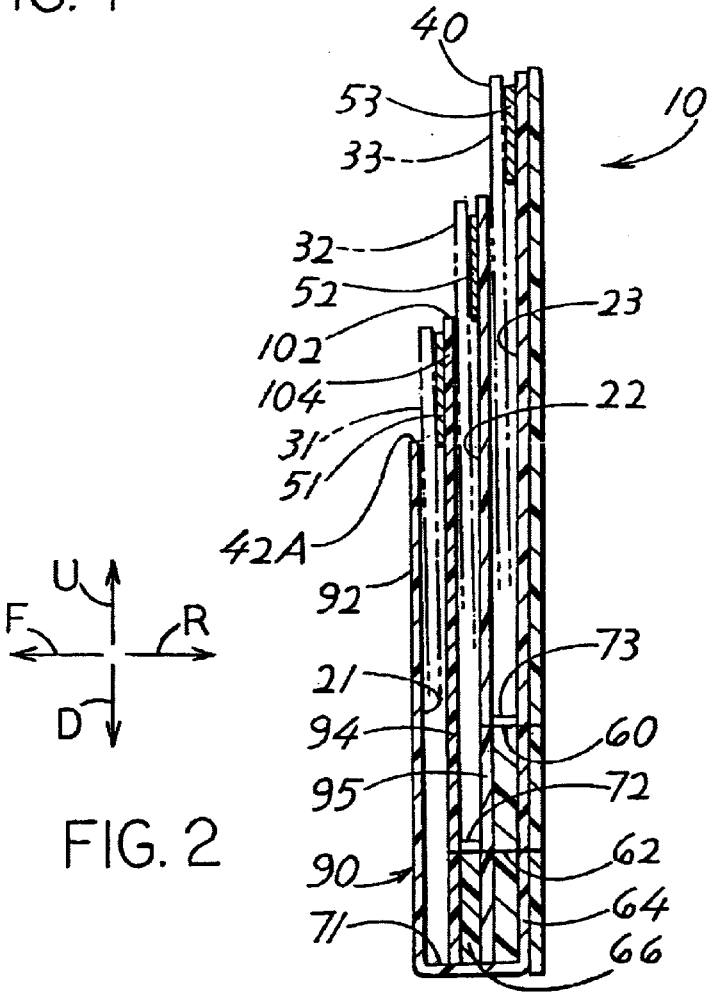
FIG. 2 is a sectional view of the holder of FIG. 1, taken on line 2—2 thereof.

FIG. 2 is a sectional view taken on line 2—2 of only the holder 10 of FIG. 1 (without the wallet or rest of the wallet), with the horizontal dimensions being exaggerated for clarity. It can be seen that stitches at 60 and 62 through bottom layers 64, 66 result in the innermost, or lower ends 71–73 of the pockets 21–23 lying at progressively lower heights at progressively more forward pockets. It is noted that in some cases the innermost end, or bottom of a pocket may not have a clearly defined bottom wall, but the pocket approximately determines the card height when the card is slipped down until it meets resistance. As a result of the pocket defining the height of the fully inserted card, when cards 31–33 of the same height are inserted into the pockets, each card upper end such as 40 is just high enough to cover a corresponding one of the three prompts 51–53. Almost all identification cards, including credit cards and driver's license have about the same size, including a height of about 2⅛ inches or 2.1 inches and a width of about 3⅜ inches or 3.4 inches. This results in each card covering its corresponding prompt 51–53 when the card lies in one of the pockets.

FIG. 3 shows the holder 10 with an insert tab 12, and also indicates an alternative insert tab 80 lying at the top of the holder rather than at a side. FIG. 3 shows no card in any of the pockets. It can be seen that all three prompts 51–53 are displayed. An arrow 82 points to the prompts to remind the person to look at the prompts. With the cards usually in the pockets there is usually no prompt 51–53 visible and the presence of the arrow repeatedly reminds the person of the presence of the prompts.

FIG. 4 shows a holder 10 with a side insert 12. Two cards 31 and 33 lie in the corresponding pockets 21 and 23 and block the views of the corresponding prompts. However, the middle pocket 22 does not contain a card, and the middle prompt 52 can be readily seen when viewing the front of the holder. The owner of the holder preferably will have become accustomed to glancing at the holder when he/she closes the wallet. The uncovered prompt 52 will call attention to itself, reminding the holder that a card is missing.

Each prompt such as 52 in FIG. 4 must call attention to itself. Applicant prefers to use a prompt with a holographic-type image, which directly reflects light from some portion of the image to a viewer at almost any location within perhaps 45° of a position directly forward of the prompt. Such holographic-type images are in widespread use on children's articles. The prompt preferably has multiple colors to further draw attention to itself. In FIG. 3 the parts 96, 97, 98 are respectively yellow, green and red. In contrast, the walls such as 90, 94 of the holder are preferably of a dark uniform color and diffuse incident light (you cannot see your reflection in it). The walls 90, 94 are leather or leather-like and are black or dark brown, so the prompts stand out when viewing the holder.

Although the holder can be supplied with an insert tab for mounting in a wallet, the insert tab can be cut off, so the holder can lie alone in a purse or suit pocket or the like. It is also possible to provide a flap that extends from an edge of the holder and that has a clasp such as of VELCRO to keep it closed over the holder except when the flap is opened to permit access to the cards and the pockets that they are supposed to lie in. In many cases, the holder will be part of the wallet, in which case the flap 12 of FIG. 1 will not be present and the front wall 90 of the first pocket will be part of the rest of the wallet. An ordinary wallet is converted into the wallet of the present invention by attaching a prompt 51–53 to the rear wall of one or more pockets that have rear walls that are displayed when the wallet is open.

In FIG. 2, the walls of the holder 10 include a first vertical (extends up U and down D) wall 92 that forms the front surface and the front wall of the front pocket 21. A second vertical wall 94 forms the rear wall of the front pocket and the front wall of the second pocket 22. A third vertical wall 95 forms the rear wall of the second pocket and the front wall of the third pocket 23, while the rearmost wall 98 forms the rear wall of the third pocket. The front pocket 21 has a top edge 42A that lies a plurality of millimeters below the height of the first card 31, so the card projects a plurality of millimeters above the top edge when the card is fully installed with its lower end lying substantially against the lower end 71 of the frontmost pocket. The wall 94 which forms the rear wall of the first pocket has a top edge 102 that lies a plurality of millimeters above the top edge 41A of the first wall 92. The prompt 41 is fastened to the top portion 104 of the second wall 94. Similarly, the top edges of the third and fourth walls 96, 98 project above the top edges of the walls in front of them, and carry the corresponding prompts 52, 53.

Each prompt preferably has a highly reflective surface with at least portions that reflect at least about half the visible light incident at a particular angle thereon to an observer in a certain position in front of the surface (up to about 45° from a direction normal to the surface). The surrounding surface of the holder or wallet is preferably a light diffusing surface that reflects less than half of the visible light incident thereon forwardly and that reflects such light diffusely. Most wallets have leather surfaces that are brown or black and that are highly diffuse and reflect less than half the incident light in most directions within an angle of 45° from a line normal to the surface. The holographic-type surfaces, whose reflections decrease in steps so that the reflectivity decreases by at least 50% at an angle that changes less than 5°, from highly reflective to only slightly reflective, is preferred, because it gets very high attention from an observer.

Figure 5:
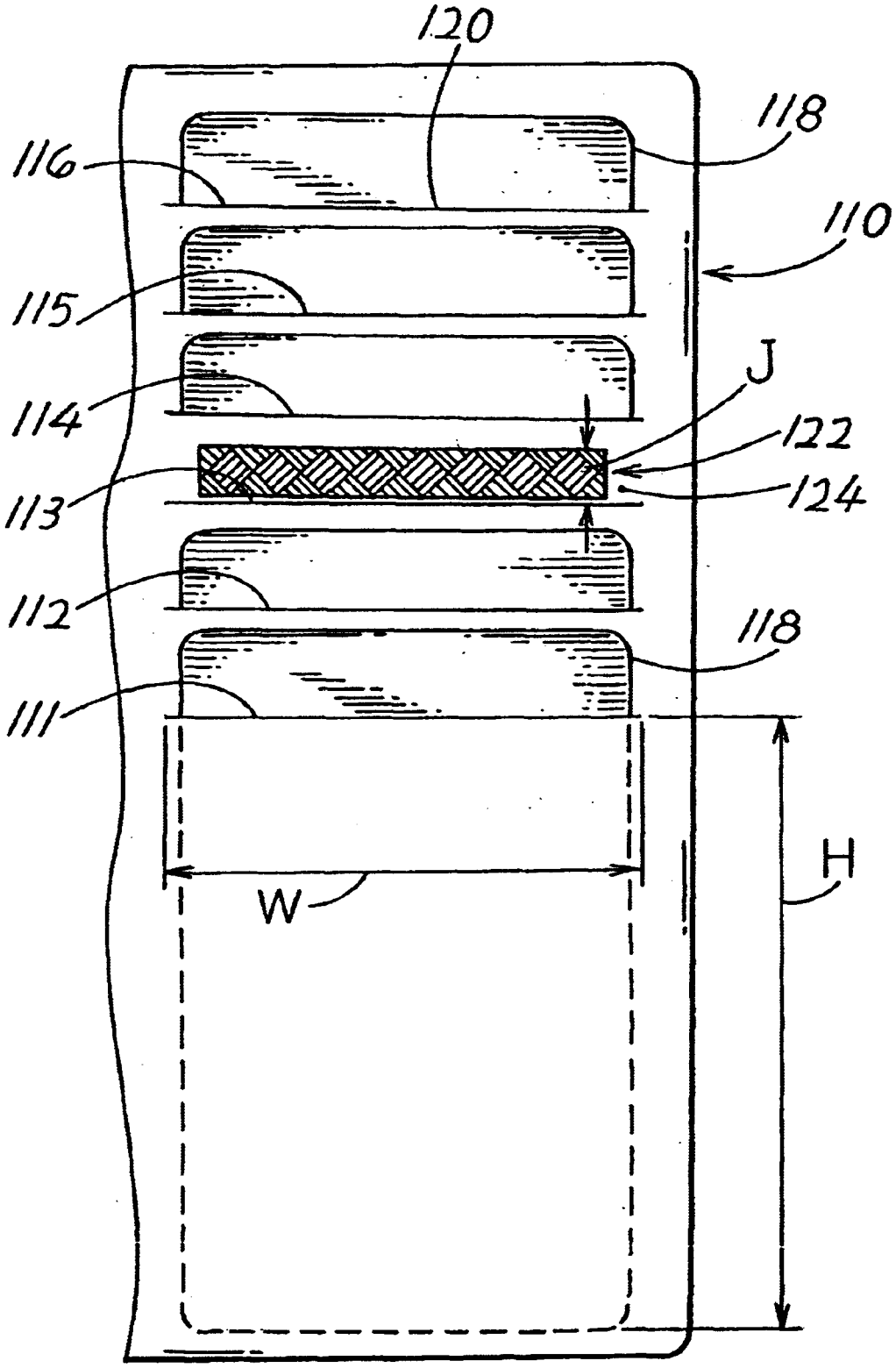
FIG. 5 is a partial front elevation view of a wallet of another embodiment of the invention.

Although cards are usually inserted into wallets with the top of the card projecting above the front wall top edge of a pocket, it is also possible to provide pockets of dimensions where a side S of a card projects above the front wall of the pocket and covers a prompt. FIG. 5 shows a portion of a wallet 110 with six pockets 111–116. Each pocket has a width W of about 2.2 inches to closely hold a card 118 of 2.1 inches horizontal dimension when installed. Each pocket has a height H of about 3 inches so a card having a height of 3.4 inches projects about 0.4 inch above the top edge 120 of the pocket. An attention getting display, or prompt, 122 lies in the region 124 above each pocket top edge, on a pocket rear wall, the region being covered by a card installed in the pocket. The prompt 122 preferably is a strip with a height J of about one-quarter inch and a width a plurality of times greater, as for the prompt of FIGS. 1–4.

Thus, the invention provides apparatus for holding identification cards, which indicates to the owner that a card of a size of about 2.1 inches by about 3.4 inches (the thickness is usually less than 1 mm) is not in a pocket. This is accomplished by providing a prompt, which is an attention-getting display, in a location that is covered when a card is inserted in the pocket. While it is possible to paint or otherwise mark the prompt on a piece of leather or the like, applicant prefers to fasten a small horizontally-elongated strip of material with a holographic-type image on it, on the leather or other material that comprises most of the holder. The holder can be a separate item or can be part of a wallet.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Apparatus for holding a credit card-type card having a height of about 2.1 inches and length of about 3.3 inches, and for indicating that a card that has been withdrawn, has not been replaced, comprising a holder having a plurality of walls forming at least one pocket that is constructed to hold one of said cards, said walls including means forming a pocket bottom wall at the bottom of said pocket that limits downward movement of a card in the pocket;

a pocket front wall that lies in front of the card and that has a front wall top edge, and a pocket rear wall that lies behind the card and that extends above said front wall top edge, said pocket rear wall having an attention-getting display extending a plurality of millimeters above said front wall top edge and positioned to be covered by a card lying fully inserted in the pocket and to be displayed when a card does not lie in the pocket;

said display comprises a horizontally-elongated strip containing a highly reflective holographic-type image that reflects differing amounts of light in different directions, with the amount of light varying in steps of over 10% with angle changes of less than 5°.

2. Apparatus for holding a credit card-type card having a first dimension of about 2.1 inches and a perpendicular second dimension of about 3.3 inches, and for indicating that a card that has been withdrawn, has not been replaced, comprising a holder having a plurality of walls forming at least one pocket that is constructed to hold one of said cards, said walls including means forming a pocket innermost wall at an innermost end of said pocket that limits inward movement of a card in the pocket;

a pocket front wall that lies in front of the card and that has a front wall outermost edge, and a pocket rear wall that lies behind the card and that extends outward of said front wall outermost edge, said pocket rear wall having an attention-getting display extending a plurality of millimeters outward of said front wall outermost edge and positioned to be covered by a card lying fully inserted in the pocket and to be displayed when a card does not lie in the pocket;

said display comprises a strip containing a highly reflective holographic-type image that reflects differing amounts of light in different directions, with the amount of light varying in steps of over 10% with angle changes of less than 5°.

* * * * *